US009841193B2

(12) United States Patent
Boujut et al.

(10) Patent No.: US 9,841,193 B2
(45) Date of Patent: Dec. 12, 2017

(54) DEVICE FOR IMPROVING COMBUSTION IN A FIREPLACE

(71) Applicant: INSTITUT POLYTECHNIQUE DE GRENOBLE, Grenoble (FR)

(72) Inventors: Jean-Francois Boujut, La Terrasse (FR); Thierry Henocque, Grenoble (FR); David Lepiney, Grenoble (FR)

(73) Assignee: INSTITUT POLYTECHNIQUE DE GRENOBLE, Grenoble (FR)

( * ) Notice: Subject to any disclaimer, the term of this patent is extended or adjusted under 35 U.S.C. 154(b) by 184 days.

(21) Appl. No.: 14/646,689

(22) PCT Filed: Nov. 22, 2013

(86) PCT No.: PCT/FR2013/052833
§ 371 (c)(1),
(2) Date: May 21, 2015

(87) PCT Pub. No.: WO2014/080142
PCT Pub. Date: May 30, 2014

(65) Prior Publication Data

US 2015/0308691 A1 Oct. 29, 2015

(30) Foreign Application Priority Data

Nov. 23, 2012 (FR) ..... 12 61158

(51) Int. Cl.
*F24B 1/19* (2006.01)
*F24B 1/188* (2006.01)
*F24B 1/193* (2006.01)

(52) U.S. Cl.
CPC ..... *F24B 1/1902* (2013.01); *F24B 1/1886* (2013.01); *F24B 1/193* (2013.01)

(58) Field of Classification Search
CPC ..... F24B 1/1886
(Continued)

(56) References Cited

U.S. PATENT DOCUMENTS 1,365,912 A * 1/1921 Greene ..... F24B 1/1886 126/518
4,122,825 A 10/1978 Slate
(Continued)

FOREIGN PATENT DOCUMENTS

EP 0019343 A1 11/1980
GB 2083209 A 3/1982

OTHER PUBLICATIONS

European Patent Office, Written Opinion of the International Search Authority for PCT/FR2013/052833, English translation, dated May 23, 2015.

(Continued)

*Primary Examiner* — Avinash Savani
(74) *Attorney, Agent, or Firm* — Kevin R. Erdman; Brannon Sowers & Cracraft PC

(57) ABSTRACT

The invention relates to a device approximately defining an L shape and comprising at least two first nested pipes in the foot of the L (32), and at least one second pipe (36) provided with at least one opening (38), in the leg of the L, the first pipes being arranged in such a way as to define a duct between one end (34) of a first central pipe and said at least one opening (38) by means of passages defined at the ends of the first pipes.

16 Claims, 5 Drawing Sheets

(58) Field of Classification Search
USPC ..... 126/512, 525, 524, 522, 527
See application file for complete search history.

(56) References Cited

U.S. PATENT DOCUMENTS

| | | | | |
|---|---|---|---|---|
| 4,291,670 | A * | 9/1981 | Hyatt | F24B 1/1886<br>126/512 |
| 4,297,986 | A | 11/1981 | Lehrer | |
| 6,484,714 | B1 * | 11/2002 | Smith | F23H 3/02<br>126/163 R |
| 2011/0005509 | A1 | 1/2011 | Marple | |

OTHER PUBLICATIONS

European Patent Office, International Search Report for PCT/FR2013/052833, dated Feb. 28, 2014.

* cited by examiner

DEVICE FOR IMPROVING COMBUSTION IN A FIREPLACE

CROSS-REFERENCE TO RELATED APPLICATIONS

The present application is a National Stage of PCT International Application Serial Number PCT/FR2013052833, filed Nov. 23, 2013, which claims priority under 35 U.S.C. §119 of French Patent Application Serial Number 1261158, filed Nov. 23, 2012, the disclosures of which are incorporated by reference herein.

BACKGROUND

The present disclosure relates to a device capable of being integrated within a fireplace. More particularly, the present disclosure relates to such a device enabling to improve the combustion inside of a fireplace.

DISCUSSION OF THE RELATED ART

Many types of fireplaces are known. Two main types of fireplaces may be distinguished: closed-hearth fireplaces where the hearth is confined in a closed enclosure, and open-hearth fireplaces where at least one wall of the hearth is in contact with free air.

Studies have shown that the combustion of wood generates a significant quantity of pollution emission, for example, carbon monoxide or fines which may be noxious for the health and for the environment. In an open-hearth fireplace, the temperature within the fireplace hearth is not sufficient for all effluents to be burnt. Incomplete combustions thus occur.

In the case of a closed-hearth fireplace, the high temperature inside of the hearth enables to limit such toxic emissions. Indeed, within a closed hearth, the combustion temperature is generally higher than 573° C., and a more complete combustion than in the case of an open hearth occurs, during which effluents noxious for the environment and for the health are burnt.

SUMMARY

An object of an embodiment is to provide a device capable of being integrated in a fireplace and enabling to perform a double combustion.

Thus, an embodiment provides a device approximately defining an L shape and comprising, in the foot of the L, at least two first nested pipes and, in the leg of the L, at least one second pipe provided with at least one opening, the first pipes being arranged in such a way as to define a duct between one end of a first central pipe and the at least one opening via passages defined at the ends of the first pipes.

According to an embodiment, the second pipe comprises a plurality of lateral openings.

According to an embodiment, the duct runs through all throughout the volume of the first and second pipes.

According to an embodiment, the first and second pipes have a circular cross-section.

According to an embodiment, the first and second pipes are made of refractory steel, of stainless steel, of cast iron, or of a metal such as copper.

According to an embodiment, the first pipes define duct stages, the stages having a cross-section which increases along with their distance to the center of the first pipes.

According to an embodiment, the cross-section of a second pipe is smaller than the cross-section of an outer stage.

According to an embodiment, the axes of the first pipes are parallel to one another and coplanar in a plane running through the second pipe, the axis of a first pipe having a first cross-section being located above the axis of a first pipe having a second cross-section if the first cross-section is larger than the second cross-section.

According to an embodiment, the device further comprises a third pipe provided with at least one additional opening, the third pipe being parallel to the second pipe, being located at the end of the first pipes opposite to the second pipe, and extending from a first intermediate pipe to form a second duct.

According to an embodiment, the device comprises three first pipes.

An embodiment further provides a block insertable in a fireplace comprising at least one device such as provided hereabove.

According to an embodiment, the block comprises at least two devices such as provided hereabove defining independent ducts, the devices being held in position by means of an armature comprising four lateral walls.

According to an embodiment, the block further comprises a removable plate capable of being positioned at the surface of the armature to close the top of the armature.

According to an embodiment, one wall of the armature comprises outlets associated with an exhaust duct.

According to an embodiment, the exhaust duct is defined along the armature, on the side of the second pipes.

BRIEF DESCRIPTION OF THE DRAWINGS

The foregoing and other features and advantages will be discussed in detail in the following non-limiting description of specific embodiments in connection with the accompanying drawings, among which:

FIGS. 6, 7, and 8 respectively are two perspective views and a cross-section view of a variation of a device according to an embodiment; and.

For clarity, the same elements have been designated with the same reference numerals in the different drawings.

DETAILED DESCRIPTION

Figure 1:
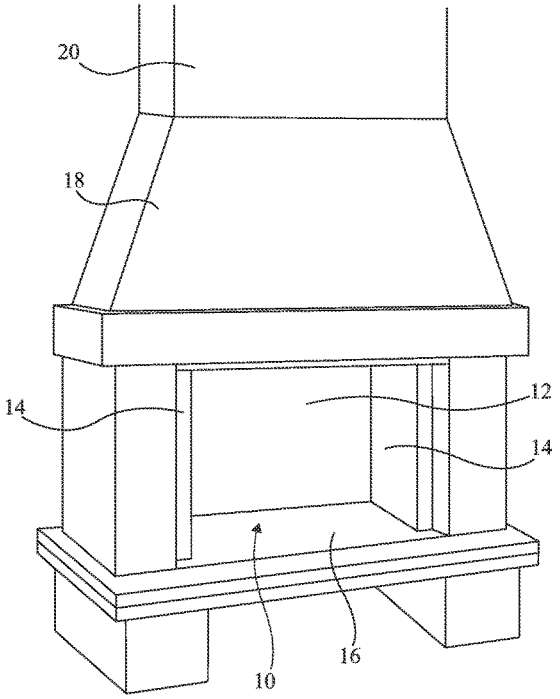
FIG. 1 is a simplified perspective view of an example of an open-hearth fireplace.

FIG. 1 illustrates an example of a fireplace where a block according to an embodiment is capable of being inserted. The fireplace shown in FIG. 1 is an open-hearth fireplace, that is, the hearth is not isolated by a closed enclosure but is created in an enclosure which is open at least on one of its sides.

It should be noted that the block improving the combustion provided herein is also capable of being integrated in a closed-hearth fireplace, or in a stove, to further improve the combustion of noxious effluents which would still be present within such a device.

In FIG. 1, the fireplace comprises a hearth 10 closed by a back wall 12, lateral walls 14, and a horizontal ground 16. The fireplace is topped by a smoke hood 18 having a cross-section which decreases to reach a fume exhaust duct 20.

In a conventional fireplace, ground 16 may be covered with fire dogs, not shown, having the logs to be burnt arranged thereon. An ash collection system, not shown, is generally provided at the level of the fireplace ground.

As seen previously, in a fireplace of the type in FIG. 1, that is, an open-hearth fireplace, the wood combustion temperature is limited by the fresh air supply on the side of the fireplace opening. Particularly, in an open-hearth fireplace, the temperature above the flames may be lower than 573° C., which only allows a partial combustion: the noxious effluents released during the main combustion of the wood (also called primary combustion) are not burnt.

A device capable of being integrated in a fireplace of the type in FIG. 1, but also in a closed-hearth fireplace, is here provided, which enables to perform a double combustion in the hearth, such a double combustion enabling to burn at least part of the noxious effluents resulting from the first combustion. Double combustion, or post-combustion, or secondary combustion, here means a combustion which is created by a supply of fresh air, the secondary air, at the level of the fumes, at a temperature sufficient for noxious gases to burn. In practice, this temperature is greater than or equal to 573° C.

Figure 2:
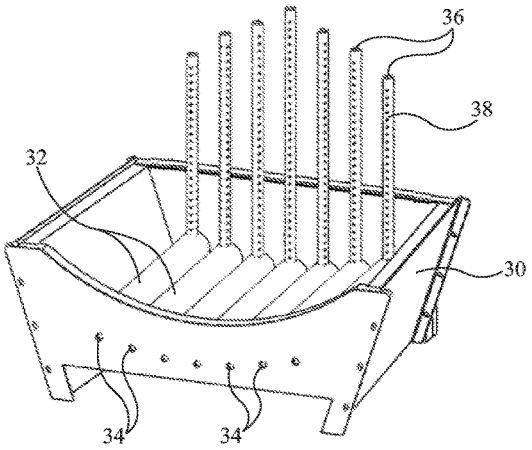
FIGS. 2 and 3 respectively are a perspective view and a cross-section view of a block according to an embodiment.

FIG. 2 is a perspective view of such a device insertable in the hearth of a fireplace.

The device of FIG. 2 comprises a container 30 defining a volume where the logs to be burnt will be laid. Container 30 for example comprises four lateral walls. The bottom of container 30 is delimited by a set of horizontal elements 32 playing the role of fire dogs. Fire dogs 32 extend between the front and the back of container 30, that is, they will be placed between the front and the back of the hearth of the fireplace being used. The fire dogs are formed, as will be seen hereafter, of a plurality of pipes, for example, which are cylindrical, nested, and communicating together.

Openings 34 are defined on the front surface of container 30, these openings corresponding to the end of the central pipes of each of fire dogs 32. Each element of larger cross-section of each of fire dogs 32 is connected, at the back of the device, that is, in the portion which will be arranged at the bottom of the fireplace hearth, to a vertical pipe 36. Vertical pipes 36 comprise a set of openings 38 preferably defined laterally and on the side of the hearth.

All throughout the present description, it will be spoken of horizontal fire dogs 32 and of vertical pipes 36. It should be noted that these horizontal and vertical directions should be interpreted as being actually substantially horizontal and substantially vertical, that is, with a 10° tolerance relative to the horizontal axis and relative to the vertical axis. Thus, the angle formed between the generating line of each fire dog 32 and the generating line of pipe 36 may vary from 70° to 110°. Further, the general shape, lengthwise, of fire dogs 32 and of pipes 36 may slightly vary with respect to a rectilinear shape. Finally, when numerical applications will be provided in the following description, each of the indicated values should be considered as being given to within 10%.

The insertable block provided herein comprises a set of independent elementary structures, each formed of a fire dog 32 and of a vertical pipe 36 held in position with respect to each other. In each of these elementary structures, fire dog 32 plays the role of an air-ember counterflow exchanger so that air, inserted through opening 34, is heated by means of the embers formed by the logs laid on fire dogs 32. The heated air then passes through means of communication between each of fire dogs 32 and each of vertical pipes 36, until it reaches openings 38 and is injected back at the level of the fire formed in the hearth.

Advantageously, the secondary air heated within fire dogs 32 and pipes 36 is sent back to the top of the flames, via openings 38, at a temperature sufficient for the mixture between this air and the gases originating from the flames of the fire present at the level of openings 38 is at a temperature higher than 573° C. Thus, the injection of secondary air via the duct formed between openings 34 and 38 enables to perform a double combustion at the level of openings 38, and thus to burn the noxious gases which are released by the primary combustion and which have not been burnt at the level of the flames. To reach sufficient temperatures, the inventors have observed that at least a double passage, and preferably a triple passage, should be provided for secondary air along the fire dog length, since a simple passage does not enable to sufficiently pre-heat the secondary air to decrease the pollution.

Fire dogs 32 are preferably arranged so that a space separates them in order for the ashes formed during the wood combustion to fall into an ash collection vessel placed under the device (not shown). As an example, to provide this function, the space between fire dogs 32 may be in the range from 5 to 20 mm, preferably 10 mm. Such a gap enables to keep hot embers above fire dogs 32, while enabling to discharge the ashes downwards.

It should be noted that each system comprising an association of a fire dog 32 and of a vertical pipe 36 operates independently and defines an independent air inlet duct. Thus, the secondary air heated at the fire dogs is distributed on each of vertical pipes 36, which makes it possible to perform a double combustion over a large surface area at the back of the fireplace.

Figure 3:
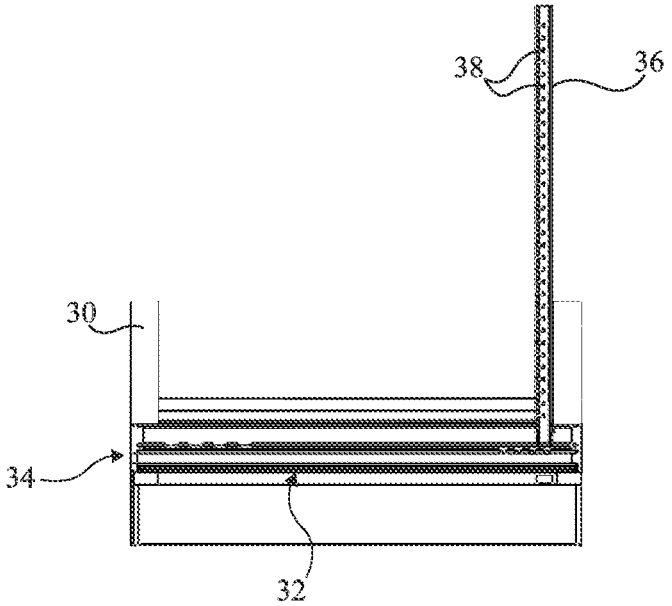
Figure 4:
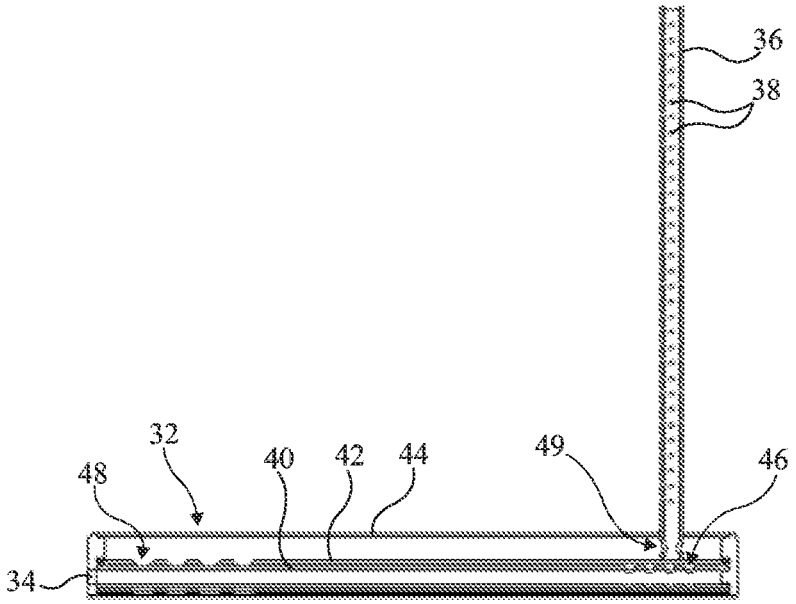
FIG. 4 is an enlarged cross-section view illustrating an elementary structure of a block according to an embodiment.

FIG. 3 is a cross-section view from front to back of the device of FIG. 2. In this drawing, the structure of fire dogs 32 and their association with vertical pipes 36 are shown in further detail. FIG. 4 shows this association only, isolated and enlarged.

As can be seen in FIGS. 3 and 4, each fire dog 32 is formed of an assembly of nested pipes. Although, in the shown example, three nested pipes are shown, it should be noted that less or more than three pipes may be used, preferably an odd number of pipes to promote the air inflow. In this example, fire dog 32 comprises a first central pipe 40, a second intermediate pipe 42, and an outer pipe 44.

Central pipe 40 has one end located at the front of the device, which matches with opening 34 of container 30. At the other end of central pipe 40, at the bottom of the device, are provided lateral openings 46 which enable air to flow from central pipe 40 into intermediate pipe 42. In this case, the bottom of central pipe 40 is closed. Preferably, lateral openings 46 are located at the bottom of pipe 40, that is, opposite to opening 34, so that air can flow all along central pipe 40 before flowing into intermediate pipe 42. At the front of the device, that is, on the side of openings 40, intermediate pipe 42 comprises lateral openings 48 which enable air to flow from intermediate pipe 42 to outer pipe 44. In this case, the front end of pipe 42 is closed.

Vertical pipe 36 is provided to nest into outer pipe 44, at the back thereof (on the side of openings 46) to form a tight assembly. According to how pipes 44 and 36 are assembled, openings 49 may be alternately provided, either in pipe 44, or in pipe 36, to enable air to flow between the two pipes.

Thus, the device defines a tight duct between air inlet point 34 and lateral openings 38 formed in vertical pipe 36.

Preferably, the axes of pipes 40, 42, and 44 are provided as being parallel and coplanar in a plane running through vertical pipe 36, the axis of an outer pipe being located above the axis of an inner pipe. This provides heat exchanges of good quality with the blaze.

It should be noted that the assembly provided herein for pipes 40, 42, and 44 is an example only, and that other assemblies enabling to perform the same function, that is, to define a duct between one end of a fire dog 32 and openings defined in the vertical pipes by snaking in the different pipes, may be provided. Particularly, pipes 40 and 42 slightly shorter than the length of fire dogs 32 and held by one of their ends may be provided, so that air flows between the pipes via the free ends of pipes 40 and 42 (on the side opposite to the pipe holding system).

In use, the logs are placed at the surface of fire dogs 32. Advantageously, such an arrangement enables to form a very hot area at the surface of fire dogs 32, which heats the air flowing through the duct formed between inlet 34 and outlets 38, and first the air in the stage defined between outer pipe 44 and intermediate pipe 42. Pipes 40, 42, and 44 define counter-flow exchangers in fire dogs 32. Advantageously, a natural air convection occurs in fire dogs 32 due to such heat exchanges.

Further, to improve heat exchanges in counterflow exchanger 32, it is provided to nest pipes 40, 42, and 44 so that their central axes are not confounded, the center of central pipe 40 being located lower than the center of intermediate pipe 42, and the center of intermediate pipe 42 being located lower than the center of outer pipe 44.

The cross-section of central pipe 40 (first stage) is further provided to be smaller than that of the second stage (internal cross-section of pipe 42 minus the external cross-section of pipe 40) and the latter is provided to be smaller than the cross-section of the third stage (internal cross-section of pipe 44 minus the external cross-section of pipe 42). This enables to provide an expansion between each stage, which also slows down the air flow between the different pipes and enables to store a larger amount of heat energy in heat exchanges with the blaze. The air is further compressed at the duct inlet, at the level of opening 34.

Further, the cross-section of the vertical pipe will preferably be smaller than the cross-section of the third stage to create, at the inlet of pipe 36, a compression and thus a new acceleration of the air flow before it comes into contact with the unburnt combustible gases to cause the double combustion at the level of openings 38. Such a configuration advantageously helps improving the natural convection of air between inlet 34 and outlets 38.

As an example of numerical application, central pipe 40 may have an inner diameter equal to 9.5 mm and a 2-mm thickness (cross-section of the first stage equal to 70.9 $mm^2$), the intermediate pipe may have an inner diameter equal to 17.3 mm and a thickness equal to 2 mm (cross-section of the second stage equal to 92 $mm^2$), outer pipe 44 may have an inner diameter equal to 36 mm and a 2-mm thickness (cross-section of the third stage equal to 661.6 $mm^2$), and vertical pipe 36 may have an inner diameter equal to 9.5 mm and a 2-mm thickness, that is, a cross-section of this pipe in the order of 70.9 $mm^2$.

Openings 46 defined between the first stage and the second stage (defined in pipe 40) may have a cross-section equal to 84.8 $mm^2$, openings 48 between the second stage and the third stage (defined in pipe 42) may have a cross-section equal to 115.5 $mm^2$, and openings 49 between the third stage and the vertical pipe (defined, for example, in the portion of vertical pipe 36 which penetrates into outer pipe 44) may have a cross-section equal to 70.9 $mm^2$. Lateral openings 38 defined along the height of pipe 36 may be formed by drilling, and may have a diameter in the range from 3 to 6 mm. It should be noted that opening 34 will advantageously be provided to have a diameter identical to the internal diameter of central pipe 40.

As an example of material, outer pipe 44 and vertical pipe 36 may be, to be compatible with a direct contact with the blaze, made of refractory or stainless steel. Pipes 40 and 42 may also be made of refractory steel or also of stainless steel. In all cases, the pipes, mainly those in contact with the blaze, will be made of a material withstanding high temperatures and having a high heat conductivity, for example, cast iron or a metal such as copper.

The walls of container 30 are preferably made of an insulating material, for example, vermiculite.

Figure 5A:
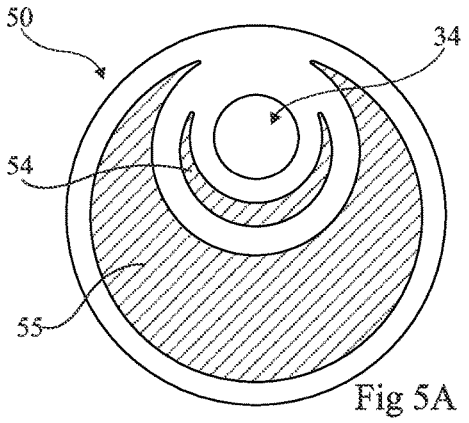
FIGS. 5A and 5B illustrate elements for holding an elementary structure according to an embodiment.
Figure 5B:
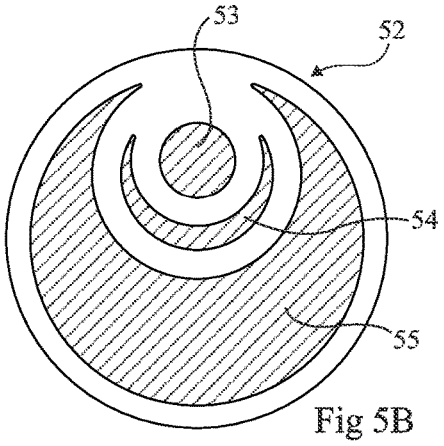

FIGS. 5A and 5B illustrate a practical embodiment of sleeves intended to be placed at the front and at the back of fire dogs 32 to hold the different pipes 40, 42, 44 in their position. In this example, pipes 40, 42, and 44 having a circular cross-section are considered.

In FIGS. 5A and 5B, a front sleeve 50 (FIG. 5A) is provided on the front portion of fire dog 32, for example, rigidly attached to container 30, and a back sleeve 52 (FIG. 5B) is provided on the back portion of container 30 to hold pipes 40, 42, and 44 in their position. Front sleeve 50 has an opening of same diameter as opening 34, intended to be positioned opposite opening 34. Sleeve 52 is tight. Opposite opening 34, the back sleeve has a raised circular portion 53. Crescent moon-shaped raised portions 54 and 55, of increasing size, are formed on the opposite surfaces of sleeves 50 and 52. Central pipe 40 is held in position between raised portions 53 and 54, intermediate pipe 42 is held in position between raised portions 54 and 55, and the outer pipe is held in position around raised portions 55.

On the outer side of sleeves 50 and 52, a raised portion or a recessed portion may be provided to hold the sleeves in container 30. It may in particular be provided for the elements holding the sleeves to ensure a proper positioning thereof, and thus of pipes 40, 42, and 44 (to provide significant heat exchanges with the blaze).

Other structures for holding pipes 40, 42, and 44 (not necessarily with a circular cross-section) within fire dogs 32 may be provided.

Figure 6:
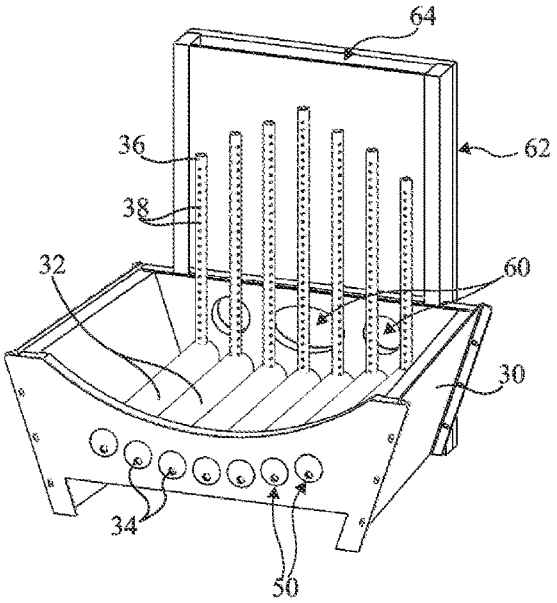

FIG. 6 illustrates an alternative embodiment of the block insertable in a fireplace of FIG. 2. In this variation, openings 60 are formed in the back portion of container 30, above fire dogs 32. A back piece 62 is placed at the back of openings 60 to form a duct 64 between openings 60 and the upper portion of the fireplace. The structure of openings 60 and of piece 62 enables to exhaust the fumes originating from the fire through duct 64. This variation is particularly advantageous in a case where the device of FIG. 2 is desired to be closed.

Figure 7:
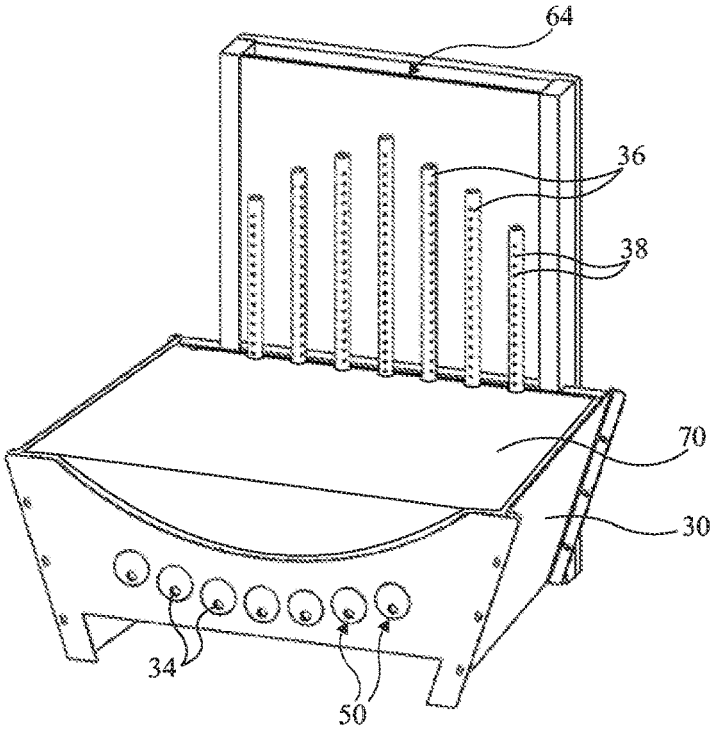

In FIGS. 6 and 7, front sleeves 50 can be seen at the front of container 30.

Figure 8:
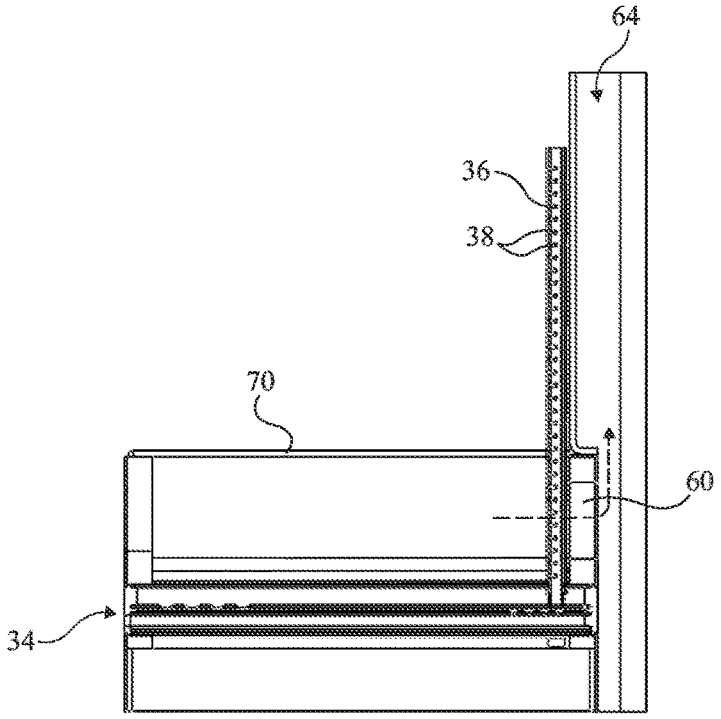

FIGS. 7 and 8 illustrate this state, respectively in perspective and in cross-section view. In this state, a removable plate 70 is placed above the blaze to tightly close container 30. The fumes originating from the combustion are then exhausted through openings 60 towards duct 64 and are redirected by this duct towards smoke hood 18 of the fireplace.

Advantageously, the closing of container 30 by plate 70 may be performed at the end of the combustion, when the fire is being extinguished. This enables to concentrate the heat inside of a stove which would have, in this case, a hearth nearly closed by plate 70. Other applications can then further be provided for the fireplace, for example, using plate 70 as food cooking means.

In the case of a use such as that provided in FIGS. 6, 7, and 8, a trap door system enabling to avoid for fumes coming out of duct 64 to be brought back into the living room may be provided in smoke hood 20 of the fireplace. To achieve this, conventional trap door systems integrated in the fireplace may be used.

Specific embodiments have been described. Various alterations and modifications will occur to those skilled in the art. It should in particular be noted that the cylindrical shape of fire dogs 32 and of pipes 40, 42, and 44 is not limiting. Indeed, these elements may have other cross-sections, for example, rectangular, triangular, hexagonal or other, and may not necessarily all have the same cross-section. Indeed, only the ratio between the cross-sections of the different elements, and their relative positioning, has an influence upon the efficiency of the device.

Similarly, pipes 36 may have a non-circular cross-section. Further, the number of structures comprising a fire dog 32 associated with a pipe 36 may vary. Indeed, this system may be adapted to fires of variable magnitude and of variable surface areas. Similarly, it may be provided to place structures allowing the double combustion at the center of the blaze only. It may also be provided to integrate a single structure comprising an association of a fire dog 32 and of a vertical pipe 36 in a fireplace.

Further, the structure of container 30 is not limiting, and even the use of this structure is not compulsory. Indeed, the elementary structures formed of a fire dog 32 and of a pipe 36 may be held together by any other means than the structure of container 30 provided herein.

Finally, although a system where each fire dog 32 comprises three nested pipes has been discussed herein, more than three pipes, or even two pipes, may be provided. Indeed, a fire dog structure comprising two nested pipes may be provided if it is sufficient to heat the secondary air up to a temperature capable of implying the second combustion. In the case of a structure with two nested pipes, the secondary air inlet into the fire dog may be provided at the back of the device. In this case, an additional duct portion allowing such an air inflow may also be provided at the back of the device. In all cases, the cross-sections of the different stages formed by the pipes in fire dogs 32 will be provided to have increasing sizes from the center to the outside, to cause the above-mentioned air expansion and compression phenomena.

Additional hot secondary air outlets may also be provided at the front of the device. In this case, additional vertical pipes, for example shorter than pipes 36 to avoid disturbing the loading of the wood, may be provided at the front of the device, the air flowing through these additional pipes originating from an intermediate pipe formed in the fire dogs.

Structures where the vertical pipes are provided to be arranged on one of or on the walls of the hearth instead of at the back thereof may also be provided. In this case, the elementary structure provided herein may be equipped with ducts for transferring the secondary air inlets to the front of the fireplace.

Further, pipes 36 have been shown herein as being formed of independent cylinders. It should be noted that other structures may be provided for pipes 36, and that it may in particular be provided to integrate these pipes in a block placed at the back of the device. Such a block where vertical ducts are defined may for example be provided, openings of communication with the outer pipe of each fire dog and openings for extracting the hot air at the level of the blaze being provided in this block.

Figure 9A:
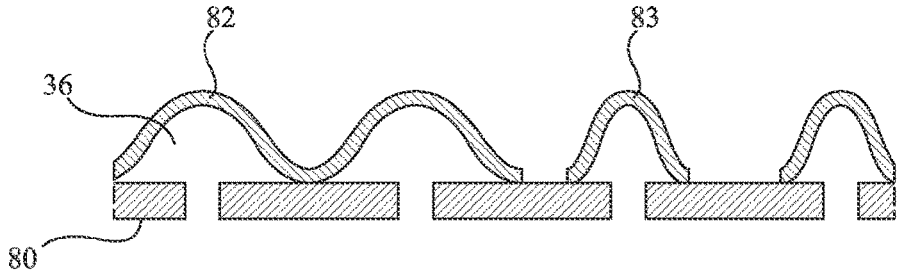
FIGS. 9A and 9B respectively show a top view and a front view of a variation of a device according to an embodiment, FIG. 9A being a cross-section view along plane A-A of FIG. 9B.
Figure 9B:
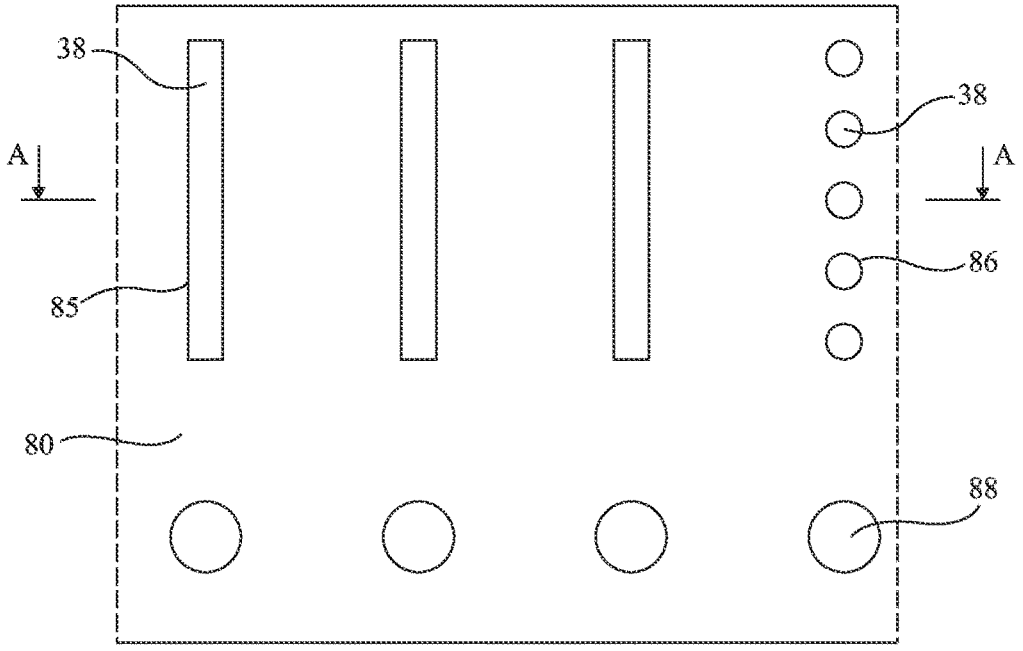

FIGS. 9A and 9B respectively show a top view and a front view of a variation of an example of a device where pipes 36 are integrated to a fireplace back plate, FIG. 9A being a cross-section view along plane A-A of FIG. 9B. A fireplace back plate, partially shown, is designated with reference numeral 80. Pipes 36 are defined by the cooperation between a sheet metal fixed (for example, soldered) to the back of the fireplace plate and the fireplace plate. According to a first variation, illustrated to the left of FIG. 9A, a continuous sheet metal 82 is used. According to a first variation, illustrated on the left-hand side of FIG. 9A, a continuous sheet metal 82 is used. According to a second variation, illustrated on the right-hand side of FIG. 9A, a series of folded sheet metals 83 is used. To define openings 38, the plate comprises slots 85 or aligned openings 86. Holes 88 in plate 80 enable to assemble the plate and the pipe-shaped fire dogs.

Finally, although pipes 36 having outlets 38 all along their height have been shown, it may be provided to form pipes 36 with openings 38 defined at desired locations only. Particularly, in the case of the variation of FIGS. 6 to 8, it may be provided not to define openings 38 in pipes 36 opposite openings 60. It may also be provided not to define lateral openings in pipes 36, but only to leave the upper end of each of pipes 36 open, the air extraction then occurring through this opening. A slight curving of this end towards the blaze may be provided.

Various embodiments with different variations have been described hereabove. It should be noted that those skilled in the art may combine various elements of these various embodiments and variations without showing any inventive step.

What is claimed is:

1. A device capable of being inserted into the hearth of a fireplace, comprising:

a first approximately horizontal portion playing the role of firedogs comprising at least two first nested pipes, and a second portion comprising at least one approximately vertical second pipe connected to the outermost of the first pipes and provided with at least one opening capable of emerging in operation into an upper portion of the hearth, the first pipes and the second pipe being arranged to define an air duct snaking between an end of a first central pipe and said at least one opening via passages defined at the ends of the first pipes, wherein the first pipes define a plurality of duct stages, said duct stages having a cross-section which increases along with their distance to the center of the first pipes.

2. The device of claim 1, wherein the second pipe comprises a plurality of lateral openings.

3. The device of claim 1, wherein the duct runs all throughout the volume of the first and second pipes.

4. The device of claim 1, wherein the first and second pipes have a circular cross-section.

5. The device of claim 1, wherein the first and second pipes are made of refractory steel, or stainless steel, of cast iron, or of a metal such as copper.

6. The device of claim 1, wherein the cross-section of a second pipe is smaller than the cross-section of an outer stage.

7. The device of claim 1, wherein the axes of the first pipes are parallel to one another and coplanar in a plane running through the second pipe, the axis of a first pipe having a first cross-section being located above the axis of a first pipe having a second cross-section, the first cross-section being larger than the second cross-section.

8. The device of claim 1, further comprising a third pipe provided with at least one additional opening, the third pipe being parallel to the second pipe, being located at the end of the first pipes opposite to said second pipe, and extending from a first intermediate pipe to form a second duct.

9. The device of claim 1, comprising three first pipes.

10. The device of claim 1, comprising a plurality of second pipes, wherein the second pipes are rigidly attached to a fireplace back plate comprising openings capable of emerging in operation into an upper portion of the hearth.

11. The device of claim 10, wherein each second pipe is formed of the assembly of a folded sheet metal and of a corresponding portion of the fireplace back plate.

12. An assembly of at least two devices capable of being inserted into the hearth of a fireplace, each of the at least two devices comprising: a first approximately horizontal portion playing the role of firedogs comprising at least two first nested pipes, and a second portion comprising at least one approximately vertical second pipe connected to the outermost of the first pipes and provided with at least one opening capable of emerging in operation into an upper portion of the hearth, wherein the first pipes and the second pipe are arranged to define an air duct snaking between and end of a first central pipe and said at least one opening via passages defined at the ends of the first pipes so that each said device defines independent ones of the air ducts, said devices being held in position by means of an armature comprising four lateral walls, wherein the first pipes define a plurality of duct stages, said duct stages having a cross-section which increases along with their distance to the center of the first pipes.

13. The assembly of claim 12, further comprising a removable plate capable of being positioned at the surface of said armature to close the top of said armature.

14. The assembly of claim 12, wherein a wall of said armature comprises outlets associated with an exhaust duct.

15. The assembly of claim 13, wherein a wall of said armature comprises outlets associated with an exhaust duct.

16. The device of claim 2, wherein the duct runs all throughout the volume of the first and second pipes.

* * * * *